US005123779A

United States Patent [19]

Miller

[11] Patent Number: 5,123,779

[45] Date of Patent: Jun. 23, 1992

[54] SUBSEA ANCHOR

[75] Inventor: Keith E. J. Miller, Maidenhead, England

[73] Assignee: Seamark Systems Limited, Broxburn, England

[21] Appl. No.: 614,448

[22] Filed: Nov. 16, 1990

[30] Foreign Application Priority Data

Nov. 17, 1989 [GB] United Kingdom ..... 8926092

[51] Int. Cl.[5] ..... E02B 3/06; E02D 5/80

[52] U.S. Cl. ..... 405/19; 405/172; 405/244; 52/155; 52/166

[58] Field of Search ..... 405/19, 172, 244, 224; 411/439, 477; 52/166, 155, 156

[56] References Cited

U.S. PATENT DOCUMENTS

| | | | |
|---|---|---|---|
| 2,947,149 | 8/1960 | Barkley | 405/244 |
| 3,969,854 | 7/1976 | Deike | 52/166 X |
| 4,688,360 | 8/1987 | Luong et al. | 52/166 |
| 4,738,063 | 4/1988 | Alsop | 52/155 X |
| 4,993,870 | 2/1991 | Bridgewater | 52/166 X |

FOREIGN PATENT DOCUMENTS

| | | | |
|---|---|---|---|
| 2470823 | 6/1981 | France . | |
| WO85/03319 | 8/1985 | PCT Int'l Appl. . | |
| WO89/04402 | 5/1989 | PCT Int'l Appl. | 405/244 |
| 802387 | 10/1958 | United Kingdom . | |
| 2089862 | 6/1982 | United Kingdom . | |

*Primary Examiner*—Randolph A. Reese
*Assistant Examiner*—Arlen L. Olsen
*Attorney, Agent, or Firm*—Oblon, Spivak, McClelland, Maier & Neustadt

[57] ABSTRACT

A ground anchor comprises an anchor plate (1) which is to be driven edge first into the ground. A flexible anchor strap or web (4) is attached to the plate, and the plate has a tail flap (7) which provides a fulcrum about which the buried anchor plate can pivot. Apparatus (5) are provided on the anchor whereby it can be driven into the ground with rotation about a generally horizontal axis. Once it is buried the strap (4) can be used to increase the rotation of the plate and thus give the plate maximum resistance to withdrawal from the ground.

7 Claims, 3 Drawing Sheets

SUBSEA ANCHOR

BACKGROUND OF THE INVENTION

This invention relates to a ground anchor especially but not exclusively for securing objects to the seabed. One instance of particular interest is the anchoring of subsea mattresses, especially viscous curtain artificial seaweed mattresses, which have to resist substantial drag forces induced by wave and current action.

A known design of ground anchor comprises an anchor plate to be driven edge first into the ground, a flexible anchor strap or web attached to the plate, the plate including a projecting tail flap and a socket or other means for receiving an end of a driving tool. In use, the plate is driven substantially vertically into the ground and when it is at the desired depth, the driving tool is withdrawn and a load is applied to the anchor strap which causes the anchor plate to pivot about the trailing flap into a skew position (and ultimately a generally horizontal position) in which it affords good anchoring. Ground anchors of this sort are shown, for example, in French patent specification no. 2470823 and European patent specification no. 0169872A.

In the anchor of the above French specification, the tail flap projects laterally of the anchor plate and so causes the formation of an entry channel in the ground which is wide in relation to the anchor plate. As a result, there is a risk of the anchor being pulled some distance back up the channel when a load is applied to the anchor strap. With a view to overcoming this and other problems, the anchor of European patent specification no. 0169872A has a hinged tail flap which can be oriented to two different angular dispositions relative to the anchor plate. The flap is maintained in the first position, at a low angle to the anchor plate, whilst the anchor is driven into the ground, but is then moved to a second position inclined at a greater angle to the plate when the driving tool is withdrawn. However, whilst this arrangement can overcome the disadvantage of the French specification anchor, it does itself suffer from the fact that it is difficult to give adequate strength to the hinged tail flap to withstand the substantial forces which can arise as load is applied to the anchor strap to turn the buried anchor into the skew position.

We have now found that by a modification in the known design of ground anchors described above, a more efficient operation of the anchor can be achieved without the various disadvantages noted above.

SUMMARY OF THE INVENTION

In accordance with the present invention, the anchor is so designed that as it is driven into the ground, it does not travel substantially vertically but rather in a curve so that, when it has reached the desired depth, its anchor plate will already be at a significant angle (e.g. at least 20°) to the vertical. Tensioning of the anchor line (after removal of the driving tool) can then complete the rotation of the anchor plate substantially to the horizontal position.

In one aspect, therefore, the invention provides a ground anchor comprising an anchor plate to be driven edge-first into the ground, a flexible anchor strap or web attached to the plate, the plate including a tail flap to provide a fulcrum about which the buried anchor plate can pivot, characterised in that means are provided on the anchor whereby it can be driven into the ground with rotation about a generally horizontal axis.

The invention also includes a method of emplacement of a ground anchor wherein the anchor is driven into the ground whilst it is rotated about a generally horizontal axis.

The invention is not limited to any particular means of achieving the rotation of the anchor whilst it is being driven into the ground. Any suitable technique can be used. One preferred way is to provide on the anchor plate a socket or the like to receive an end of the driving tool, the socket being offset to one side of the plate and lying in a plane normal to the plane of the plate and passing through the vertical center line thereof in a way such that the downward driving force applied thereto also creates a turning moment on the anchor about a generally horizontal axis. Another way is to incline the socket at an angle, for example up to about 15°, to the plane of the plate. Alternatively, the plate and/or driving member can be so shaped or configured to provide the desired turning force (in addition to downward drive) in some other way.

In the anchors of the invention, the tail flap is preferably fixed (and not hinged) to give it maximum strength. It is generally at an angle of from 30° to 45° to the plate.

The anchor strap can be attached to the anchor plate in any suitable way. One preferred arrangement is to provide slots in the anchor plate and to pass the strap through the slots. The position of attachment must of course be appropriate for obtaining the required turning moment about the tail flap when the anchor has been buried. Generally, the position of attachment is preferably at or close to the centre of the anchor plate.

The retaining socket for the spigot or driving tool is preferably set towards the leading edge of the anchor plate but at some distance from the central line of the anchor plate. We have found that the plate of this design rotates through between 30°–45° when driven into typical seabed soil to depth of about 1 meter. The reciprocating action of the hydraulic gun used to provide the driving impulse causes a small rotation of the plate at each blow because of the offset nature of the retaining socket.

Once the anchor plate has been driven to the desired depth and degree of rotation, and the spigot driving tool withdrawn, a short vertical movement of the anchor strap or line causes the tail flap to engage the soil and the anchor plate to rotate to the horizontal position. In this position, the anchor plate is carrying the maximum loading possible for the size of plate, depth of burial and local geotechnical factors.

BRIEF DESCRIPTION OF THE DRAWINGS

By way of example only, the invention will now be described with reference to the accompanying drawings, in which.

DESCRIPTION OF THE PREFERRED EMBODIMENTS

Figure 1:
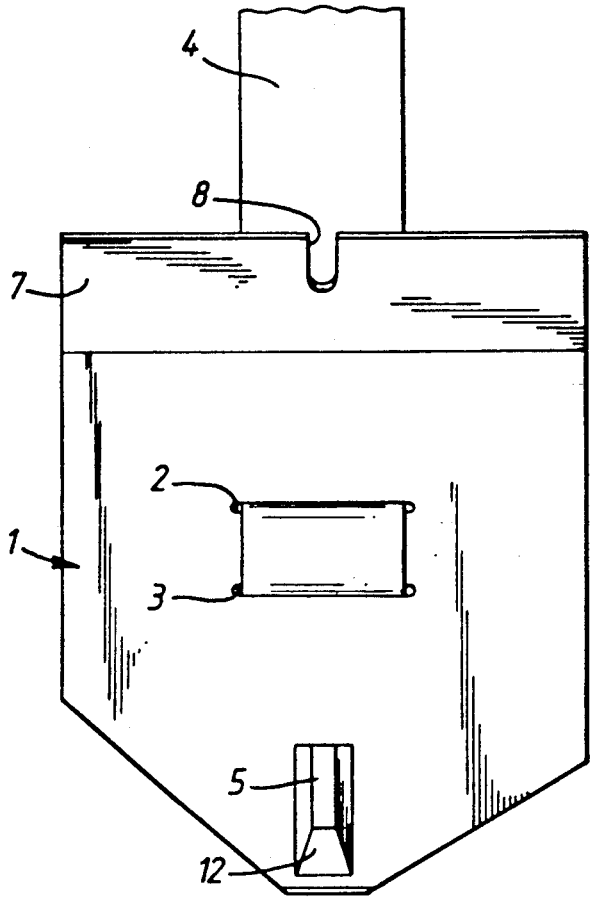
FIG. 1 is a front elevation of the anchor plate and socket of one embodiment of the invention.
Figure 2:
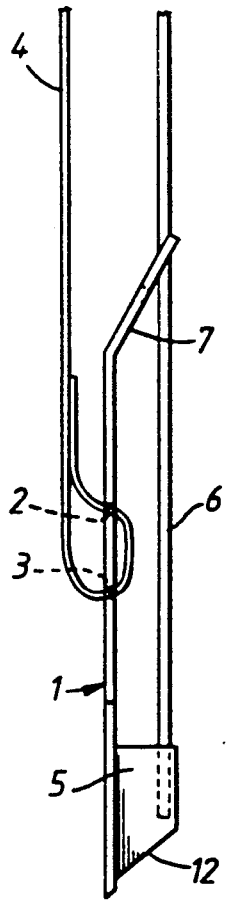
FIG. 2 is a side elevation of the anchor plate, socket and driving spigot.

FIGS. 1 and 2 show a ground anchor having a generally flat anchor plate 1 having a wedge-shaped lower edge to assist insertion of the plate into the ground. The plate includes a pair of substantially parallel slots 2 and 3, or any other suitable means, for receiving a flexible webbing loop or anchor strap 4. An elongated socket 5 is fitted by welding or similar means to the frontside of the anchor plate but at a considerable offset to the centre plane of the plate. FIG. 2 shows the driving tool or spigot 6 located in the drive socket. A rearward projecting tail flap 7 is shown extending from the plate on the same side of the plate as the socket 5. The flap 7 has a slot 8 which allows the spigot to enter the socket.

Figure 3:
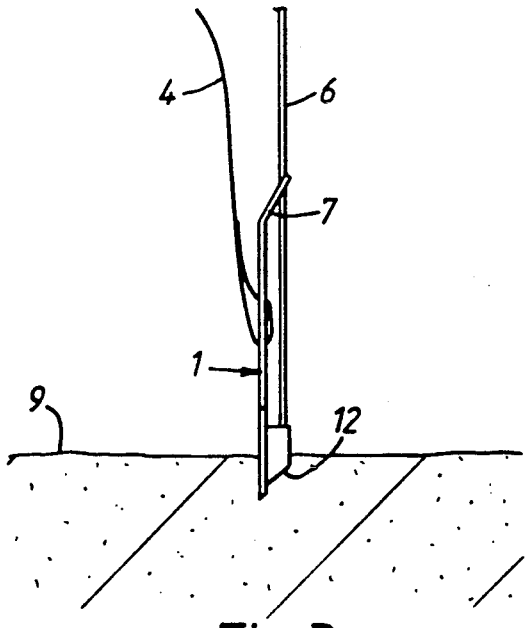
FIG. 3 shows the anchor plate being driven into the ground by a driving spigot.

FIG. 3 shows the anchor plate 1 in position as it initially engages with the soil 9. The spigot 6 and plate 1 are in a vertical orientation.

Figure 4:
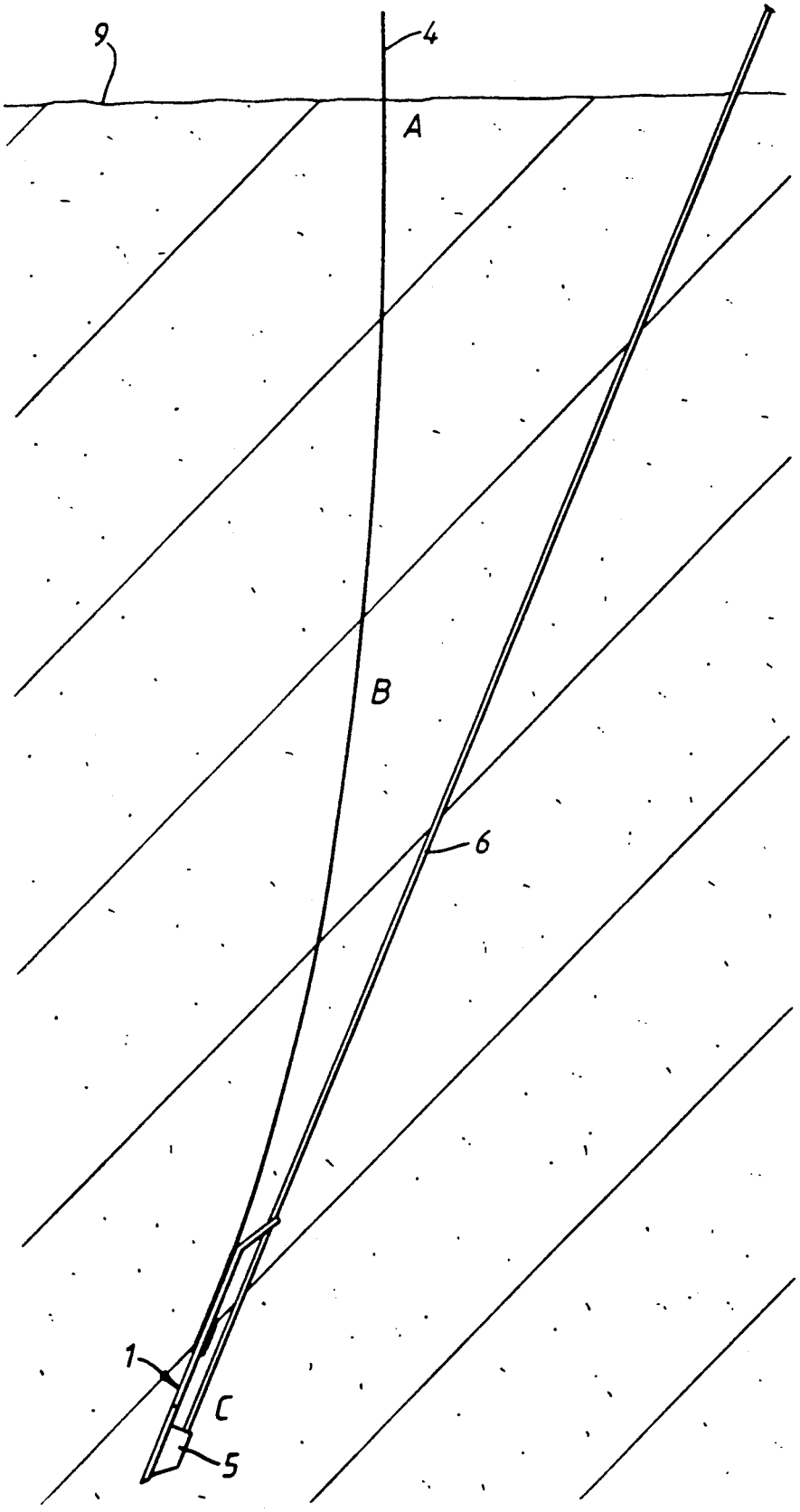
FIG. 4 shows the anchor plate at its final location after the driving operation has been completed.

FIG. 4 shows the anchor plate 1 at fully driven depth. Because the driving tool or spigot 6 applies a force via the socket 5 which is offset from the plane of the main body of the plate 1 it also provides a moment which tends to rotate the plate about a generally horizontal axis as it penetrates through the soil. The anchor strap 4 traces a shallow curve, defined by A, B and C, as the spigot and anchor plate rotate through approximately 30°–45°. The spigot 6 is a slender metallic member which easily cuts through the soil to effect this rotation caused by the offset nature of the socket 5. The spigot is withdrawn when the plate reaches the position C.

Figure 5:
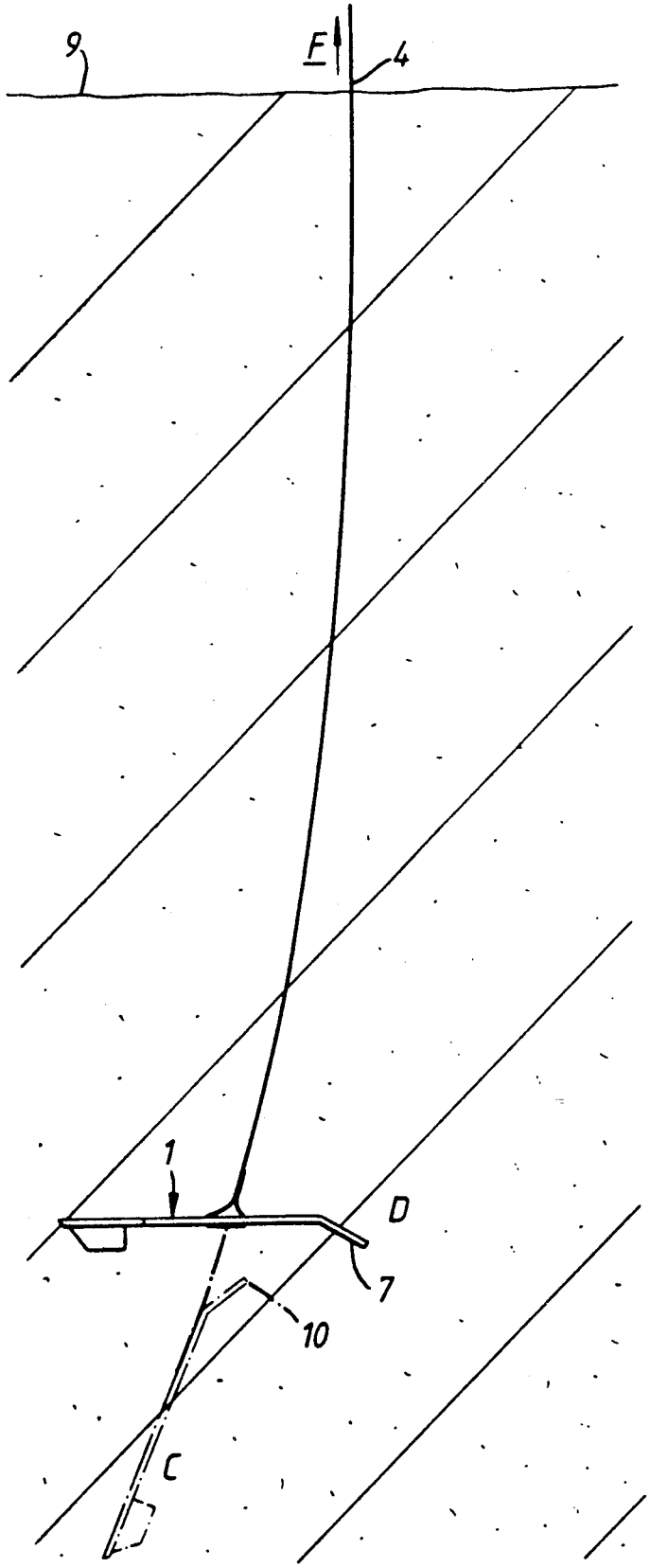
FIG. 5 shows the anchor plate after minimal vertical displacement and further rotation of the plate.

FIG. 5 shows the orientation of the anchor plate 1 to position D after the imposition of a load F on the anchor strap 4. The rearward projecting tail flap 7 resists the tendency to allow withdrawal straight up to the hole wall. cut by the initial driving in of the anchor. The flap bites into the hole as soon as the withdrawing force is applied, creating a fulcrum 10 about which the anchor rotates to position D. Once in position D, after a minimum vertical displacement, the anchor plate is producing the maximum resistance possible for its plan area.

Figure 6:
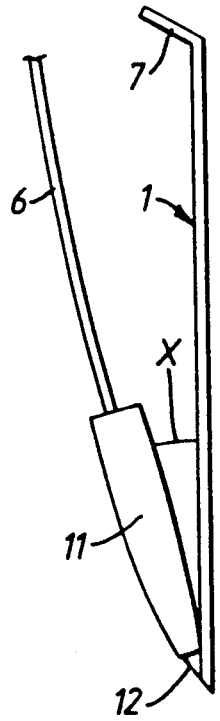
FIG. 6 is a schematic side view of the anchor plate showing a modification to the socket.

The socket can be modified as shown in FIG. 6 where an angled socket 11 is fitted to the frontside of the anchor plate 1. This modification also effectively generates a turning moment on the plate as it is driven into the ground by means of the driving tool 6 located in the socket 11. The angle X may have a magnitude of up to about 15°.

The socket 5 or 11 shown in the Figures preferably has an angled lower end 12, thus presenting less resistance to insertion into and penetration through the soil.

I claim:

1. A ground anchor comprising an anchor plate to be driven edge-first into the ground, a flexible anchor strap attached to the plate, a tail flap on said plate to provide a fulcrum about which the anchor plate when buried is pivotable, and socket means, positioned on said anchor plate at an angle of up to 15 degrees, a driving tool therein with respect to the plane of the anchor plate, said socket means being offset to one side of said plate and lying in a plane normal to the plane of said plate and passing through the vertical center line thereof, the amount of offset being such that a driving force applied to said socket means also creates a turning moment on the anchor plate about a generally horizontal axis whereby as said anchor plate is driven into the ground it is also rotated about said generally horizontal axis.

2. A ground anchor according to claim 1, wherein said tail flap extends rearwardly of said plate and at an angle to said plate.

3. A ground anchor according to claim 1, wherein said socket is positioned on said anchor plate towards the leading edge of said plate.

4. A ground anchor according to claim 1 wherein the anchor strap is attached substantially at the center of the plate.

5. A ground anchor according to claim 1, wherein said tail flap is a rigid extension of said plate.

6. A ground anchor according to claim 1 additionally comprising two slots formed in the anchor plate, the anchor strap being attached to the plate through said slots.

7. A method for emplacement of a ground anchor comprising:

determining an angle of up to 15 degrees for positioning of a socket on an anchor plate;

providing the socket on the anchor plate at said angle;

inserting a driving tool into the socket at said angle so that said driving tool has an axis converging with respect to the plane of the anchor plate; and driving the anchor into the ground so that it is rotated about a generally horizontal axis while it is driven into the ground.

* * * * *